US011014322B2

(12) United States Patent
Yokota

(10) Patent No.: US 11,014,322 B2
(45) Date of Patent: May 25, 2021

(54) CASE-MAKING DEVICE

(71) Applicant: ISHIDA CO., LTD., Kyoto (JP)

(72) Inventor: Yuji Yokota, Ritto (JP)

(73) Assignee: ISHIDA CO., LTD., Kyoto (JP)

( * ) Notice: Subject to any disclaimer, the term of this patent is extended or adjusted under 35 U.S.C. 154(b) by 173 days.

(21) Appl. No.: 16/100,203

(22) Filed: Aug. 10, 2018

(65) Prior Publication Data

US 2019/0054713 A1 Feb. 21, 2019

(30) Foreign Application Priority Data

Aug. 18, 2017 (JP) ..... JP2017-157940

(51) Int. Cl.

| | |
|---|---|
| ***B31B 50/02*** | (2017.01) |
| ***B31B 50/04*** | (2017.01) |
| ***B31B 50/06*** | (2017.01) |
| ***B31B 50/80*** | (2017.01) |
| *B31B 120/30* | (2017.01) |
| *B31B 100/00* | (2017.01) |

(52) U.S. Cl.

CPC ..... *B31B 50/022* (2017.08); *B31B 50/044* (2017.08); *B31B 50/06* (2017.08); *B31B 50/064* (2017.08); *B31B 50/80* (2017.08); *B31B 2100/0022* (2017.08); *B31B 2120/302* (2017.08)

(58) Field of Classification Search

CPC ..... B31B 50/022; B31B 50/06; B31B 50/064; B31B 50/044; B31B 50/80; B31B 2100/0022; B31B 2120/302

See application file for complete search history.

(56) References Cited

U.S. PATENT DOCUMENTS 2,782,695 A * 2/1957 Meissner ..... B65B 43/285 493/181
3,420,036 A * 1/1969 Hutchinson ..... B65B 43/305 53/566
3,564,980 A 2/1971 Winters
(Continued)

FOREIGN PATENT DOCUMENTS

DE 2155230 A1 5/1973
JP H06-199319 A 7/1994
(Continued)

OTHER PUBLICATIONS

The Examination report No. 1 from the corresponding Patent Application in the Australia No. 2018217301 dated Dec. 13, 2018.
(Continued)

*Primary Examiner* — Nathaniel C Chukwurah
*Assistant Examiner* — Lucas E. A. Palmer
(74) *Attorney, Agent, or Firm* — Shinjyu Global IP

(57) ABSTRACT

It is generally a goal to reduce the height dimension of a case-making device. A case-making device 90 comprises a box-sheet-holding part 10 and an extraction part 20. The box-sheet-holding part 10 holds a plurality of box sheets S to be processed into container boxes B such that the box sheets S extend in an upright direction UR. The extraction part 20 extracts one box sheet S from the box-sheet-holding part 10. An upright-direction UR dimension of the box sheet S is a first dimension H1. The extraction part 20 moves the box sheet S in the upright direction UR by a second dimension H2 shorter than the first dimension H1.

8 Claims, 9 Drawing Sheets

(56) References Cited

U.S. PATENT DOCUMENTS 3,613,526 A * 10/1971 Jones ..... B31B 50/00 493/313
3,828,659 A * 8/1974 Reichert ..... 493/313
3,859,896 A * 1/1975 Mims ..... B31B 50/00 493/26
4,041,850 A * 8/1977 Reichert ..... B65B 43/185 493/123
4,201,118 A * 5/1980 Calvert ..... B65B 43/305 493/125
4,348,853 A * 9/1982 Morse ..... B65B 43/205 493/122
4,441,377 A * 4/1984 Nowacki ..... B31B 50/00 74/105
4,787,881 A * 11/1988 Andersson ..... B65B 43/265 493/316
5,186,706 A * 2/1993 Hartness ..... B31B 50/00 414/795.8
5,393,291 A * 2/1995 Wingerter ..... B31B 50/00 493/116
5,588,643 A * 12/1996 Tagliaferri ..... B31B 50/00 271/10.07
6,669,616 B1 * 12/2003 Bierenacki ..... B31B 50/00 493/309
2015/0298842 A1 10/2015 Yokota et al.

FOREIGN PATENT DOCUMENTS

JP H08-58735 A 3/1996
JP 2014-061635 A 4/2014
JP 2017-013335 A 1/2017

OTHER PUBLICATIONS

The Search Report from the corresponding European Patent Application No. 18188745.6 dated Dec. 19, 2018.

* cited by examiner

CASE-MAKING DEVICE

CROSS-REFERENCE TO RELATED APPLICATIONS

This application claims priority to Japanese Patent Application No. 2017-157940 filed on Aug. 18, 2017. The entire disclosure of Japanese Patent Application No. 2017-157940 is hereby incorporated herein by reference.

TECHNICAL FIELD

The present invention relates to a case-making device.

BACKGROUND ART

The case-making device disclosed in patent literature 1 (Japanese Laid-open Patent Publication No. H6-199319) folds a dedicated cardboard sheet to produce a container box.

SUMMARY OF THE INVENTION

Technical Problem

Case-making devices are often bulky. Case-making devices especially tend to be tall, and therefore often cannot be placed in transport containers.

The object of the present invention is to reduce a height dimension of a case-making device.

Solution to Problem

A case-making device according to a first aspect of the present invention comprises a box-sheet-holding part and an extraction part. The box-sheet-holding part holds a plurality of box sheets to be processed into container boxes such that the box sheets extend in an upright direction. The extraction part extracts one of the box sheets from the box-sheet-holding part. An upright-direction dimension of the box sheet is a first dimension. The extraction part moves the box sheet in the upright direction by a second dimension wherein the second dimension is shorter than the first dimension.

According to this configuration, the one box sheet extracted by the extraction part partially overlaps the remaining box sheets by the difference between the first dimension and the second dimension. The box sheet is opened in this state and processed into a container box. Therefore, because the box sheet is not separated from the remaining box sheets in the vertical direction when the box sheet is opened, the height dimension of the case-making device can be reduced.

A case-making device according to a second aspect of the present invention is the case-making device according to the first aspect, wherein the upright direction is a direction that is inclined not less than 0° and not more than 30° from the vertical direction.

According to this configuration, the box sheet is placed in the box-sheet-holding part so as to have a small inclination of not less than 0° and not more than 30° from the vertical direction. Therefore, because the group of box sheets is supported by the support member with a small force, the one box sheet to be processed into a container box is readily extracted.

A case-making device according to a third aspect of the present invention is the case-making device according to the first or second aspect, wherein the extraction part raises the box sheet upward.

According to this configuration, the extraction part extracts only the one box sheet from the remaining box sheets by raising the one box sheet. Therefore, the structure of the extraction part is simple.

A case-making device according to a fourth aspect of the present invention is the case-making device according to any one of the first to third aspects, wherein the box-sheet-holding part has a support member to support a surface of the box sheet. The support member supports a location on the box sheet from a lower edge of the box sheet. The dimension of this supported location is preferably less than the second dimension.

According to this configuration, the support member of the box-sheet-holding part supports a location from the lower edge of the box sheet, whereby the dimension of this supported location is preferably less than the second dimension. Therefore, because the box sheet can be freely opened in a space beyond than the second dimension, the height dimension of the case-making device can be reduced.

A case-making device according to a fifth aspect of the present invention is the case-making device according to any one of the first to fourth aspects, wherein the box sheet has flaps. The box sheet is placed in the box-sheet-holding part such that the flaps are disposed on an upper side and a lower side.

According to this configuration, the box sheet is placed such that the flaps are disposed on the upper and lower sides. In many cases, the flap separation direction in a box sheet is the same as the direction in which a short edge of the box sheet extends. Therefore, because the short edge of the box sheet extends upward and downward, the height dimension of the case-making device can be reduced.

A case-making device according to a sixth aspect of the present invention is the case-making device according to any one of the first to fifth aspects, wherein the case-making device further comprises a plurality of suction tools to grip the surface of the box sheet moved by the extraction part by suctioning air. At least some of the plurality of suction tools move, whereby the box sheet is opened.

According to this configuration, the box sheet is opened by the movement of some of the suction took. Therefore, the box sheet is processed into a container box.

A case-making device according to a seventh aspect of the present invention is the case-making device according to the sixth aspect, wherein the plurality of suction tools includes a first suction tool to grip a first surface of the box sheet, and a second suction tool to grip a second surface of the box sheet that is on the opposite side from the first surface.

According to this configuration, each of the first suction tool and the second suction tool grips a surface on opposing sides of the box sheet. Therefore, the box sheet is readily opened in a reliable manner.

A case-making device according to an eighth aspect of the present invention is the case-making device according to the sixth or seventh aspect, wherein when a not-yet-opened box sheet is gripped by the plurality of suction tools, the box sheet takes on an orientation in the vertical direction.

According to this configuration, the box sheet takes on an orientation in the vertical direction when gripped by the suction tools. Therefore, because a bottom edge of the container box to be assembled becomes horizontal, the container box is easy to handle.

A case-making device according to a ninth aspect of the present invention is the case-making device according to any one of the sixth to eighth aspects, wherein a difference in height between an upper edge of the box sheet gripped by the suction tools and a lower edge of the box sheets held by the box-sheet-holding part is less than double the first dimension of the box sheet.

According to this configuration, the box sheet gripped by the suction tools and the box sheets held by the box-sheet-holding part are not separated in the height direction. Therefore, the height dimension of the case-making device can be reduced.

A case-making device according to a tenth aspect of the present invention is the case-making device according to any one of the sixth to ninth aspects, wherein when the extraction part supports the box sheet and the suction tools grip the box sheet, the box sheet folds at a crease sandwiched between a portion supported by the extraction part so as to follow the upright direction and a portion gripped by the suction tools so as to follow the vertical direction.

According to this configuration, a crease in the box sheet is used in changing the orientation of the box sheet. Therefore, damage to the box sheet can be suppressed.

Advantageous Effects of Invention

The height dimension of the case-making device according to the present invention is small.

DESCRIPTION OF EMBODIMENTS

A case-making device 90 according to one embodiment of the present invention is described with reference to the drawings.

(1) Box Sheet

Figure 1:
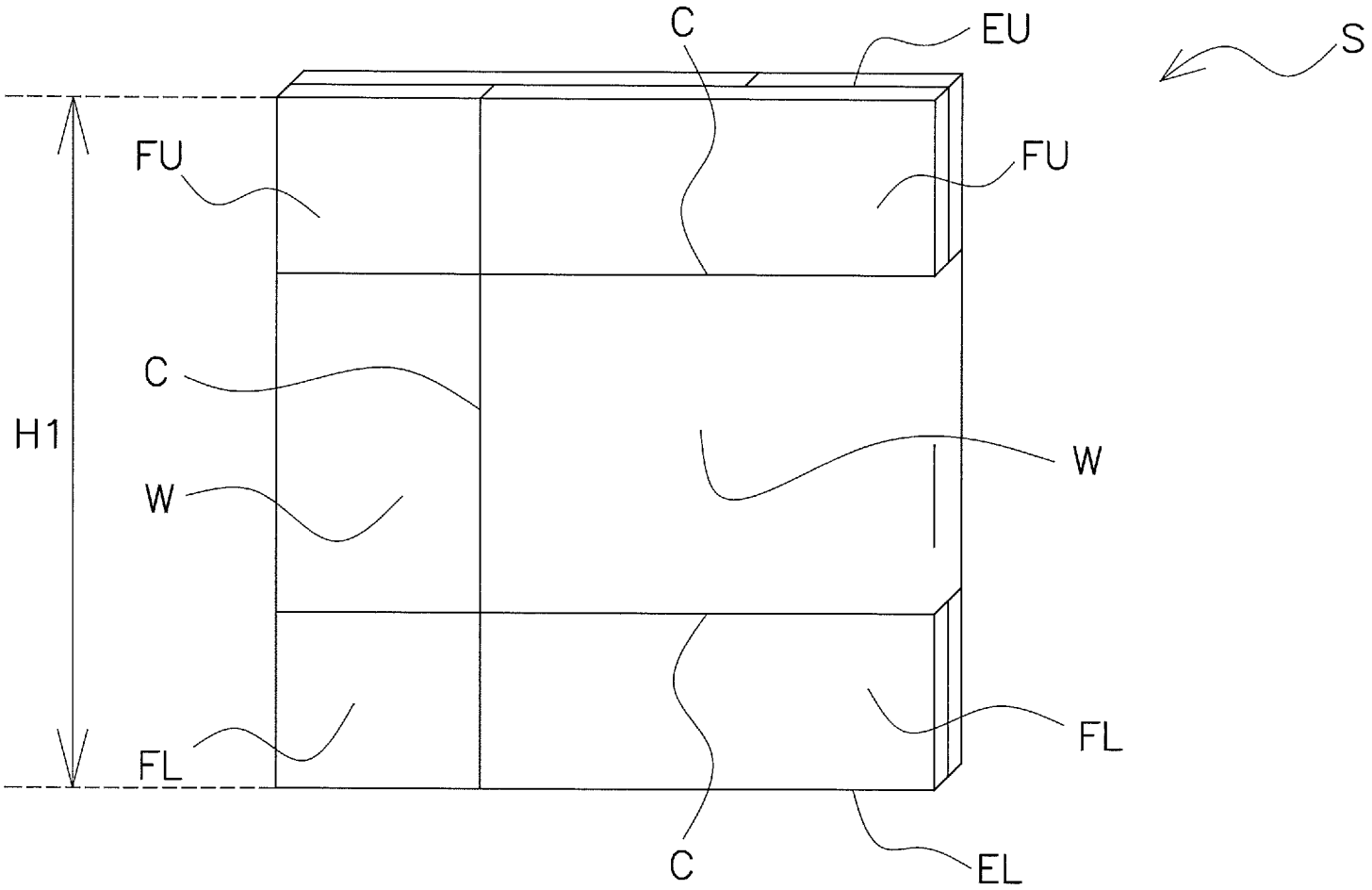
FIG. 1 is a schematic view of a box sheet S handled by a case-making device 90 according to the present invention.

FIG. 1 shows a box sheet S handled by the case-making device 90. The box sheet S is made of cardboard. The box sheet S has four wall parts W connected in a ring shape, and upper flaps FU and lower flaps FL that extend from the wall parts W. The upper flaps FU serve as a lid of a container box. The lower flaps FL serve as a bottom of the container box. Creases C are formed at the boundaries between adjacent wall parts W, at the boundaries between the wall parts W and the upper flaps FU, and at the boundaries between the wall parts W and the lower flaps FL. The box sheet S readily folds at the creases C. A distance between an upper edge EU and a lower edge EL of the box sheet S is a first dimension H1.

(2) Configuration

Figure 2:
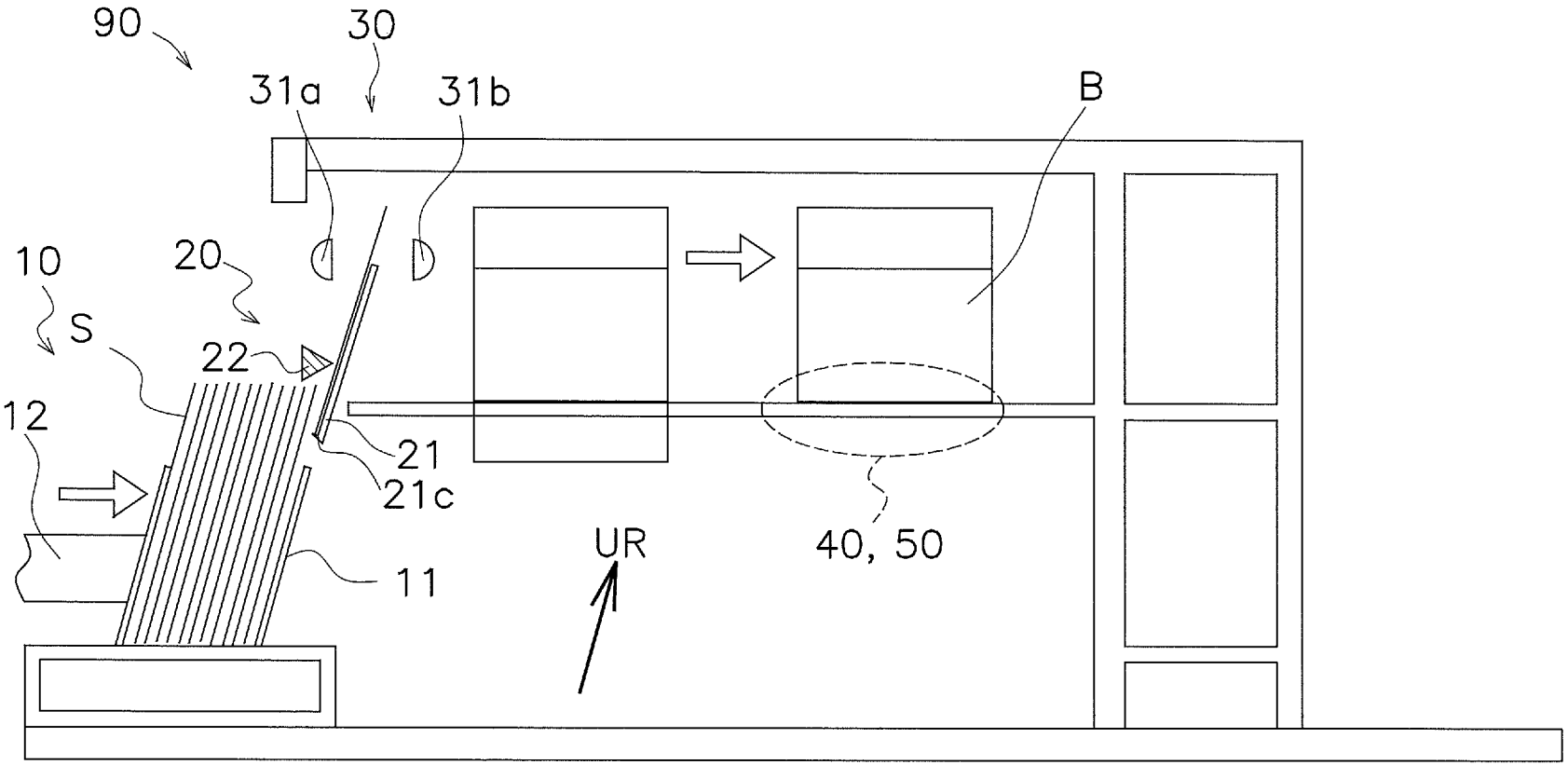
FIG. 2 is a side view schematically showing a case-making device 90 according to one embodiment of the present invention.

FIG. 2 shows the case-making device 90. The case-making device 90 folds the box sheet S and forms a container box B in a state in which the upper flaps FU are opened. The case-making device 90 has a box-sheet-holding part 10, an extraction part 20, a case-opening part 30, a lower-flap-folding mechanism 40, and a tape-applying mechanism 50.

(2-1) Box-Sheet-Holding Part 10

The box-sheet-holding part 10 is a portion in which a group of box sheets S is placed. The box-sheet-holding part 10 has a support member 11 and a sheet-pushing mechanism 12. The support member 11 is a flat-plate-shaped member that supports the box sheets S. The support member 11 extends in a direction of standing upright (referred to as "upright direction UR" below), said direction having an incline of not less than 0° and not more than 30° relative to a vertical direction. The sheet-pushing mechanism 12 pushes the box sheet S with an appropriate force. The support member 11 is capable of withstanding the weight of the box sheets S and the force of the sheet-pushing mechanism. The box sheets S are held by the box-sheet-holding part 10 so as to extend in the upright direction UR.

(2-2) Extraction Part 20

The extraction part 20 extracts one box sheet S that is the closest to the support member 11 from the group of box sheets S placed on the box-sheet-holding part 10. The extraction part 20 has a reciprocating member 21, a folding assist member 22, and a motor (not shown). The reciprocating member 21 is capable of reciprocating in the upright direction UR. A small hook part 21*c* for raising the one box sheet S is provided at a lower end of the reciprocating member 21. The motor raises or lowers the reciprocating member 21. The function of the folding assist member 22 is described later.

(2-3) Case-Opening Part 30

The case-opening part 30 opens the box sheet S. The case-opening part 30 has a first suction tool 31*a*, a second suction tool 31*b*, an arm 32 (FIG. 9), and a vacuum pump (not shown). The first suction tool 31*a* and the second suction tool 31*b* are made of a flexible soft material so as to be capable of closely fitting with the box sheet S. The first suction tool 31*a* is provided on the sheet-pushing-mechanism 12 side. The second suction tool 31*b* is provided on the reciprocating-member 21 side. At least one first suction tool 31*a* or at least one second suction tool 31*b* is provided on each side with reference to the box sheet S extracted by the extraction part 20. The first suction tool 31*a* and the second suction tool 31*b* are connected to the vacuum pump, and grip the surface of the box sheet S by suctioning air. The arm 32 opens the box sheet S by moving at least the second suction tool 31*b*.

(2-4) Lower-Flap-Folding Mechanism 40

The lower-flap-folding mechanism 40 folds the lower flaps FL of the opened box sheet S and produces a bottom of the container box B.

(2-5) Tape-Applying Mechanism 50

The tape-applying mechanism 50 applies adhesive tape to the folded lower flaps FL, thereby reinforcing the container box B.

(3) Detailed Configuration

Figure 3:
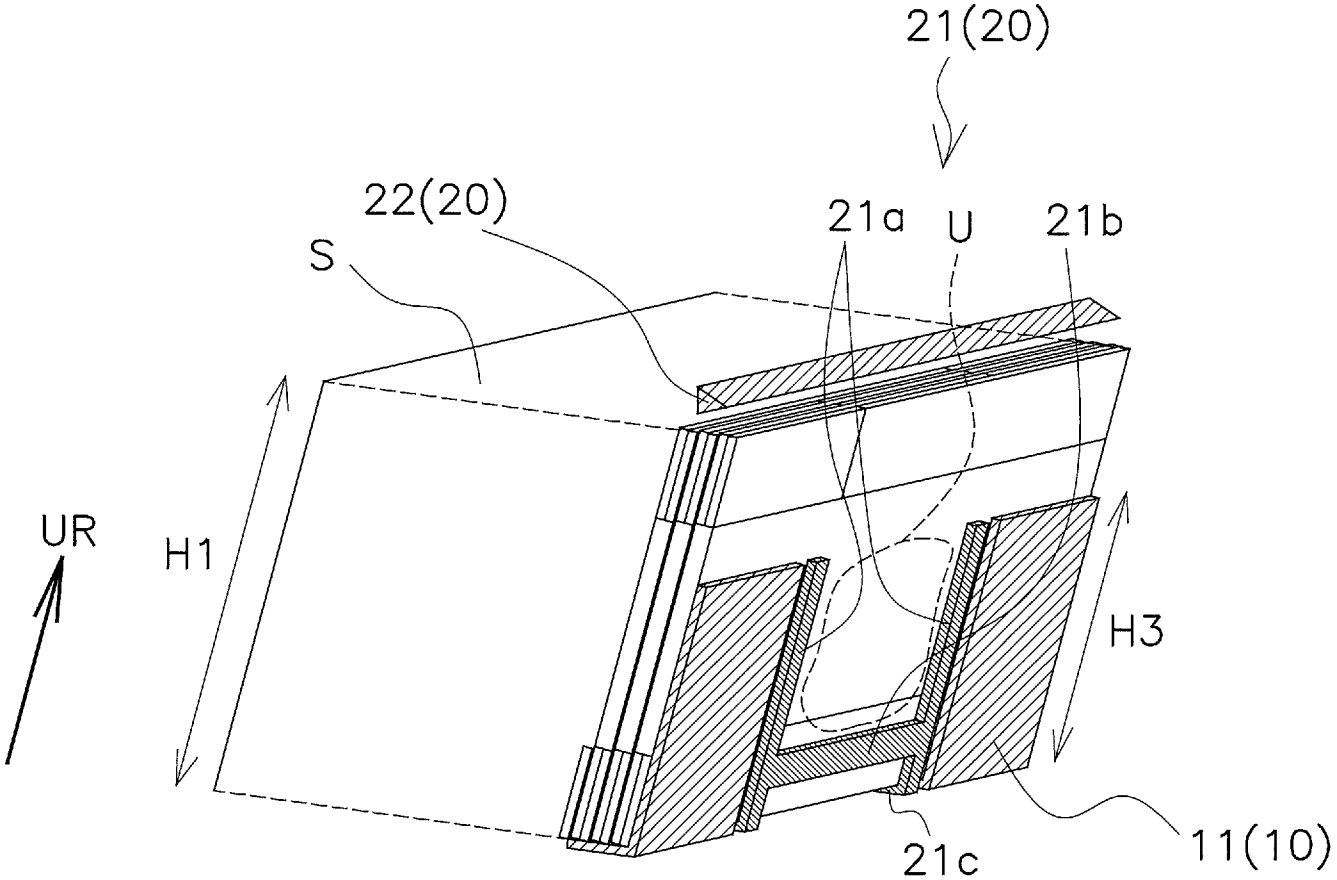
FIG. 3 is a diagram of a box-sheet-holding part 10.

FIG. 3 shows the box-sheet-holding part 10 holding a group of box sheets S. An upright-direction UR dimension of the box sheets S is a first dimension H1. Two support members 11 are provided to two width-direction end parts of the box sheets S. An upright-direction UR dimension of the support members 11 is a third dimension H3. The third dimension H3 is shorter than the first dimension H1. The reciprocating member 21 is provided between the two support members 11. According to this structure, the reciprocating member 21 is prevented from interfering with the support members 11. The hook part 21*c* provided at the lower end of the reciprocating member 21 is of such size as to raise only one box sheet S. The reciprocating member 21 has two column members 21*a* extending in the upright direction UR and one beam member 21*b* connecting the two column members. According to this structure, a space U that opens upward and is surrounded by the two column members 21*a* and the beam member 21*b* is formed in the reciprocating member 21. The folding assist member 22 is provided higher than the upper edge EU of the box sheet S.

Figure 4:
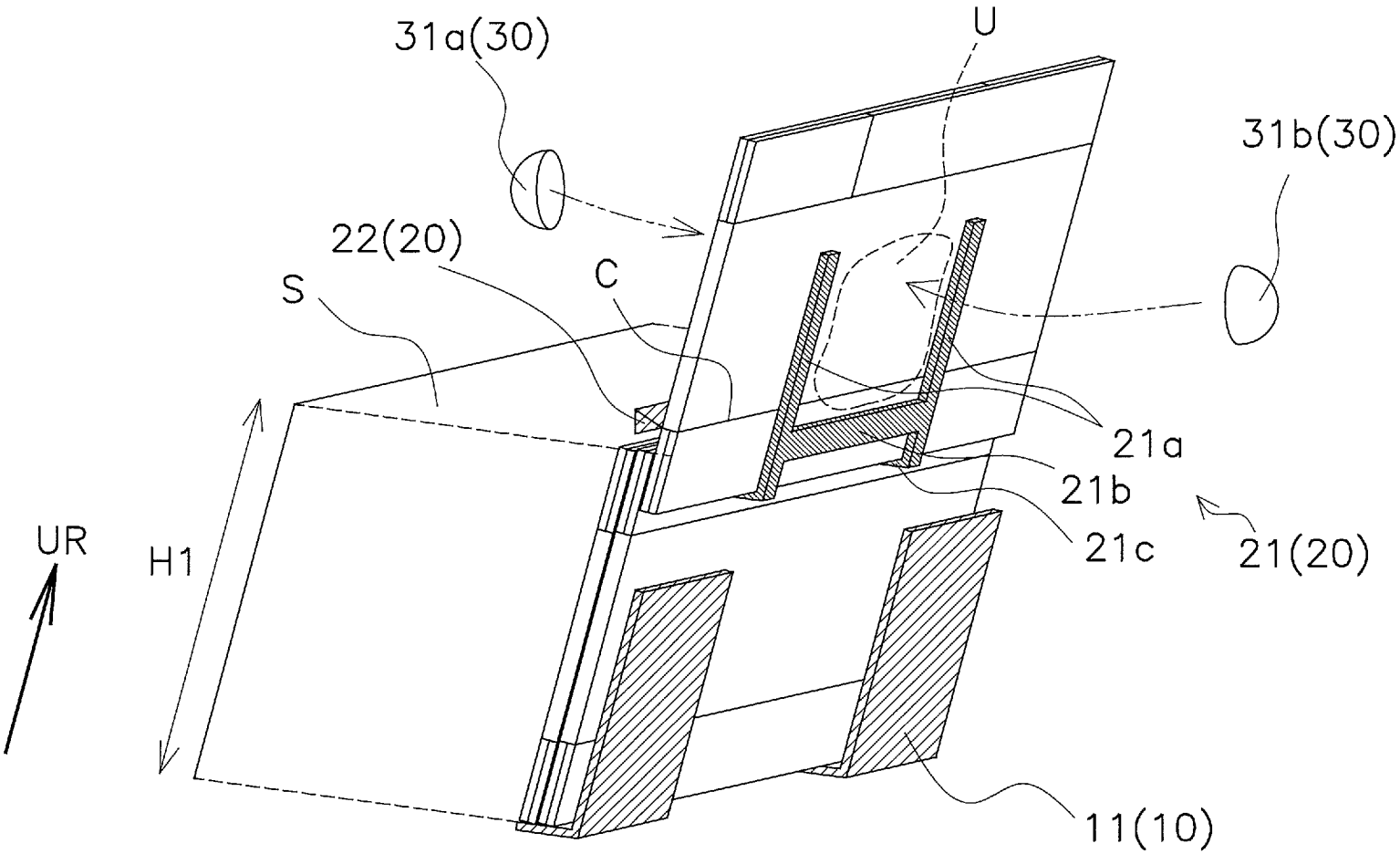
FIG. 4 is a diagram of a box-sheet-holding part 10.

FIG. 4 shows the state of the box-sheet-holding part 10 when one box sheet S is extracted by the extraction part 20. The folding assist member 22 comes into contact with a crease C that defines a boundary between the wall parts W and the lower flaps FL of the box sheet 5, or with the vicinity of the crease C. The first suction tool 31*a* and the second suction tool 31*b* of the case-opening part 30 approach the box sheet S from the two sides of the box sheet S. At this time, the second suction tool 31*b* comes into contact with the box sheet S in the aforementioned space U that opens upward.

(4) Operation

Figure 5:
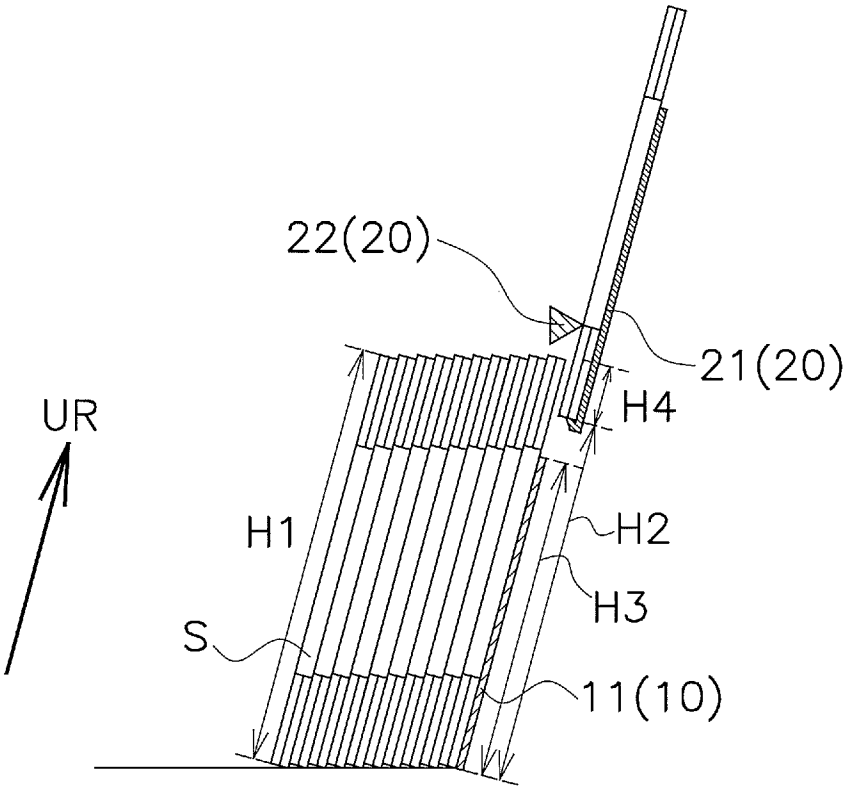
FIG. 5 is a side view illustrating one step in a case-making operation.

The steps by which the case-making device 90 produces a container box B from the box sheet S are as described below. First, as shown in FIG. 5, the reciprocating member 21 of the extraction part 20 raises one of the box sheets S placed on the box-sheet-holding part 10 by a second dimension 112. This box sheet S is placed in the upright direction UR. The second dimension H2 is shorter than the first dimension H1. The folding assist member 22 comes into contact with the raised box sheet S at the crease C that defines the boundary between the wall parts W and the lower flaps FL, or in the vicinity of the crease C. The support members 11 extend by the third dimension H3 in the upright direction UR. The third dimension is shorter than the second dimension H2. The raised box sheet S overlaps the group of box sheets S held by the box-sheet-holding part 10 over a fourth dimension H4 extending in the upright direction UR. The fourth dimension H4 is the difference between the first dimension H1 and the second dimension H2.

Figure 6:
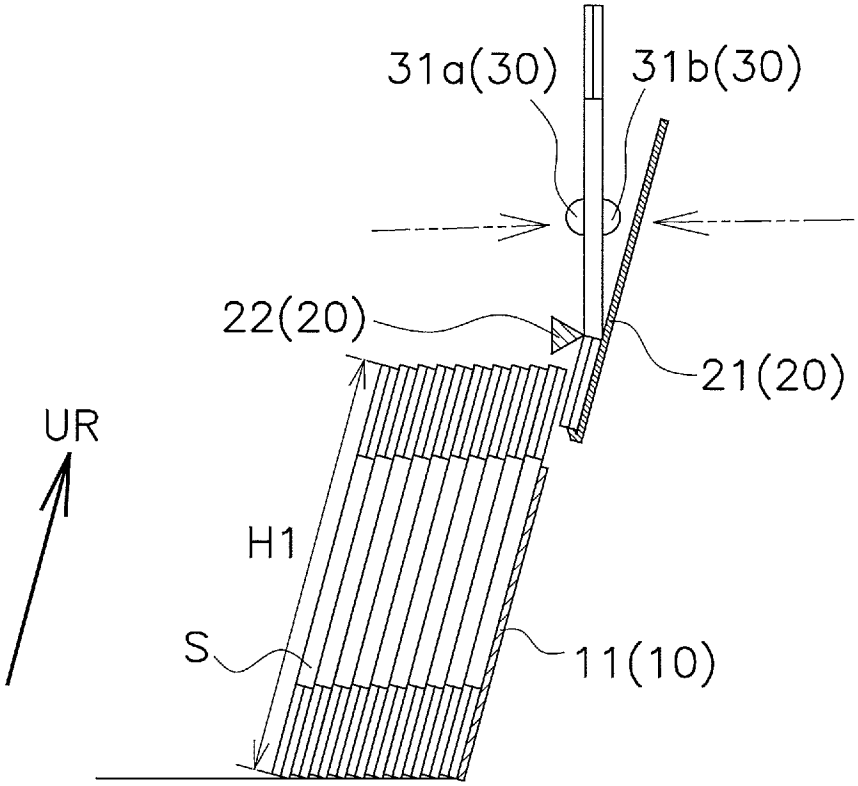
FIG. 6 is a side view illustrating one step in a case-making operation.
Figure 7:
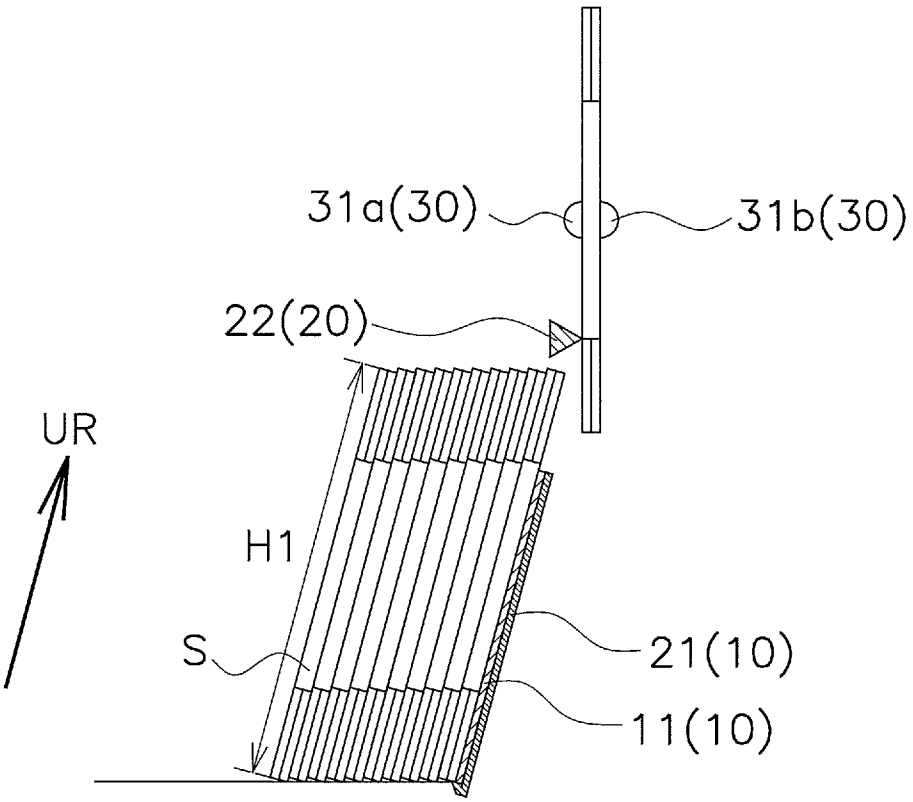
FIG. 7 is a side view illustrating one step in a case-making operation.

Next, as shown in FIG. 6, the first suction tool 31*a* and the second suction tool 31*b* of the case-opening part 30 sandwich and grip the box sheet S. The second suction tool 31*b* comes into contact with the box sheet S through the space U. At this time, because the folding assist member 22 supports the crease C of the box sheet S, the box sheet S folds at the crease C. An upper-side portion of the box sheet S is gripped by the first suction tool 31*a* and the second suction tool 31*b* and extends in the vertical direction. A lower-side portion of the box sheet S is supported by the reciprocating member 21 and the folding assist member 22 and extends substantially in the upright direction UR. The lower-side portion of the box sheet S overlaps upper-side portions of the remaining box sheets S placed on the box-sheet-holding part 10. A difference in height between the upper edge EU of the box sheet S, gripped by the first suction tool 31*a* and the second suction tool 31*b*, and the lower edge EL of the group of box sheets S held by the box-sheet-holding part 10 is less than double the first dimension H1 of the box sheet S.

Next, as shown in 7, the reciprocating member 21 of the extraction part 20 descends. At this time, the entirety of the box sheet S released from the support of the reciprocating member 21 extends in the vertical direction. The second suction tool 31*b* grips the box sheet S in the space U that opens upward, and therefore the reciprocating member 21 and the second suction tool 31*b* do not interfere with each other when the reciprocating member 21 descends.

Figure 8:
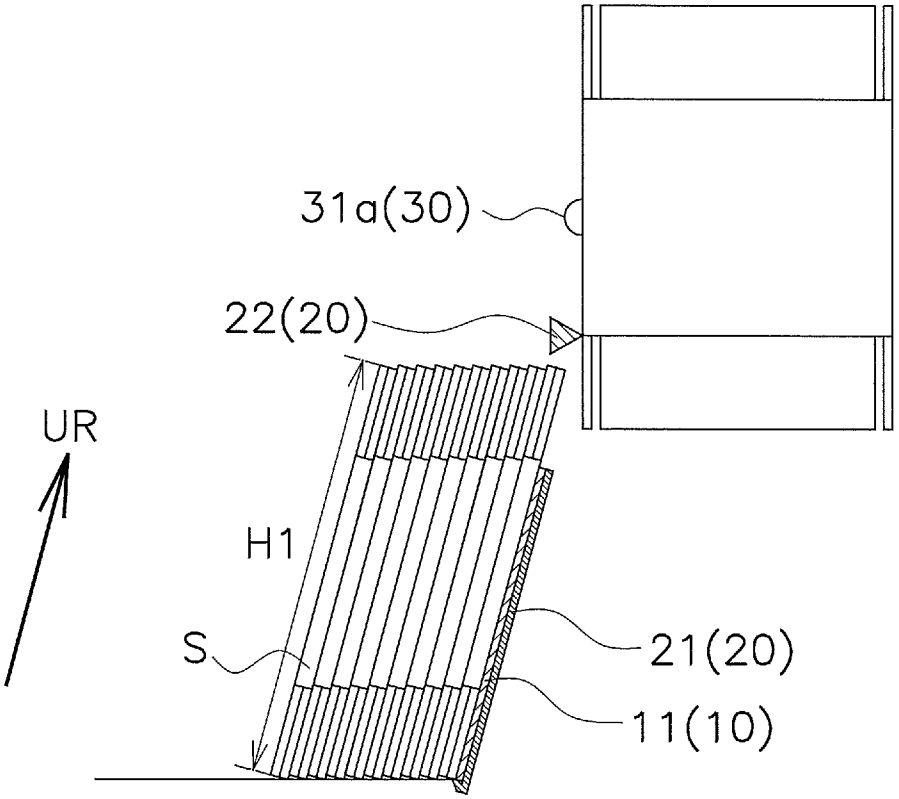
FIG. 8 is a side view illustrating one step in a case-making operation.
Figure 9:
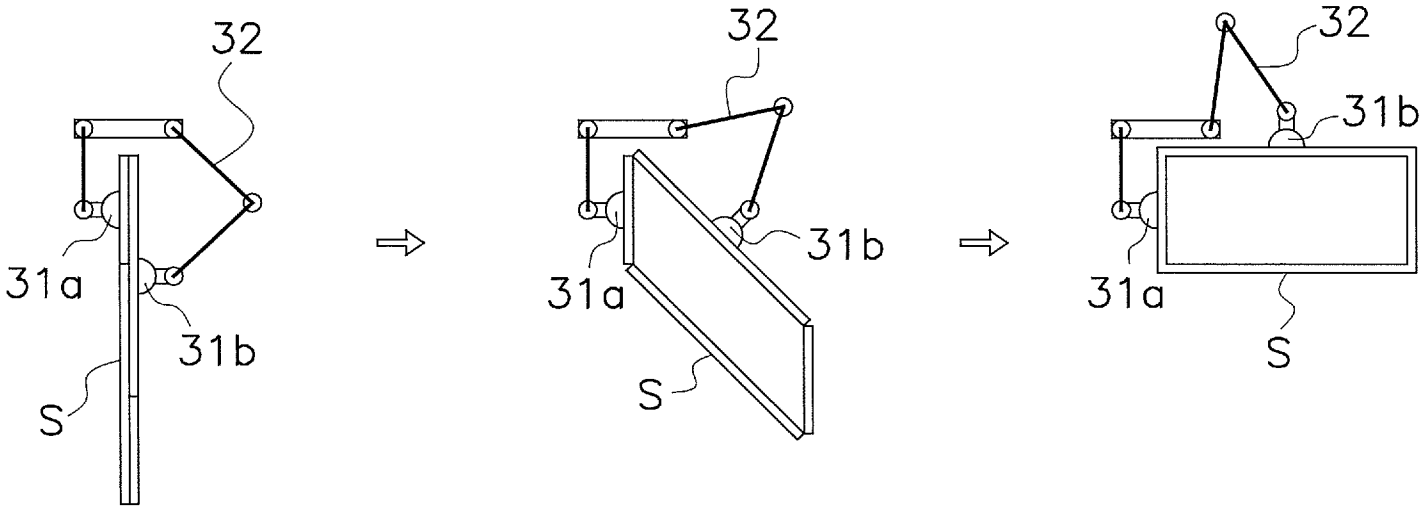
FIG. 9 is a plan view illustrating a case-making operation.

Next, as shown in FIG. 8, the second suction tool 31*b* moves to thereby open the box sheet S. FIG. 9 is a plan view showing steps by which the box sheet S is opened. The first suction tool 31*a* grips a first surface of the box sheet S. The second suction tool 31*b* grips a second surface of the box sheet S that is on the opposite side from the first surface. The first suction tool 31*a* grips a wall part W that serves as a short edge of the container box B. The second suction tool 31*b* grips a wall part W that serves as a long edge of the container box B. The arm 32 moves the second suction tool 31*b* to thereby open the box sheet S.

(5) Characteristics (5-1)

The one box sheet S extracted by the extraction part 20 partially overlaps the remaining box sheets S by the fourth dimension H4, which is the difference between the first dimension H1 and the second dimension H2. In this state, the box sheet S is opened and processed into a container box B. Therefore, because the box sheet S does not separate from the remaining box sheets S in the vertical direction when the box sheet S is opened, the height dimension of the case-making device 90 can be reduced.

(5-2)

The box sheet S is placed on the box-sheet-holding part 10 so as to have a small inclination of not less than 0° and not more than 30° from the vertical direction. Therefore, because the group of box sheets S is supported by the support member 11 with a small force, the one box sheet S to be processed into a container box B is readily extracted.

(5-3)

The extraction part 20 extracts only one box sheet S from the remaining box sheets S by raising the one box sheet S. Therefore, the structure of the extraction part is simple.

(5-4)

The support member 11 of the box-sheet-holding part 10 supports a location over the third dimension H3 from the lower edge of the box sheet S. The third dimension H3 is shorter than the second dimension H2. Therefore, because the box sheet can be freely opened in a space equal to or greater than the second dimension H2, the height dimension of the case-making device can be reduced.

(5-5)

The box sheet S is placed such that the upper flaps FU and the lower flaps FL are disposed on the upper and lower sides. In many cases, the flap separation direction in a box sheet S is the same as the direction in which a short edge of the box sheet S extends. Therefore, because the short edge of the box sheet S extends upward and downward, the height dimension of the case-making device 90 can be reduced.

(5-6)

The box sheet S is opened by the movement of the second suction tool 31*b*. Therefore, the box sheet S is processed into a container box B.

(5-7)

Each of the first suction tool 31*a* and the second suction tool 31*b* grips a surface on opposing sides of the box sheet S. Therefore, the box sheet S is readily opened in a reliable manner.

(5-8)

The box sheet S takes on an orientation along the vertical direction when gripped by the first suction tool 31*a* and the second suction tool 31*b*. Therefore, because a bottom edge of the container box B to be processed becomes horizontal, the container box B is easy to handle.

(5-9)

The box sheet S gripped by the first suction tool 31*a* and the second suction tool 31*b* and the box sheets S held by the box-sheet-holding tool 10 are not separated in the height direction. Therefore, the height dimension of the case-making device 90 can be reduced.

(5-10)

The crease C in the box sheet is used in changing the orientation of the box sheet S. Therefore, damage to the box sheet S can be suppressed.

(6) Modifications (6-1)

The structure of the reciprocating member 21 is not limited to only having two column members 21*a* and one beam member 21*b*. Other configurations may be employed, provided that there is a space U that opens upward.

(6-2)

The structure of the support member 11 is not limited to being of a flat plate shape. A rod-shaped member, a lattice-shaped member, or another such structure may be employed, provided that the group of box sheets S can be securely supported.

REFERENCE SIGNS LIST

10 Box-sheet-holding part
11 Support member
12 Sheet-pushing mechanism
20 Extraction part
21 Reciprocating member
21*a* Column member
21*b* Beam member
21*c* Hook part
22 Folding assist member
30 Case-opening part
31*a* First suction tool
31*b* Second suction tool
32 Arm
40 Lower-flap-folding mechanism
50 Tape-applying mechanism
90 Case-making device
B Container box
C Crease
EL Lower edge
EU Upper edge
FL Lower flap
FU Upper flap
H1 First dimension
H2 Second dimension
H3 Third dimension
H4 Fourth dimension
S Box sheet
U Space
UR Upright direction
W Wall part

CITATION LIST

Patent Literature

Japanese Laid-open Patent Publication No. H6-199319

The invention claimed is:

1. A case-making device comprising:

a box-sheet-holding part to hold a plurality of box sheets to be processed into container boxes such that the box sheets extend in an upright direction, each box sheet having upper flaps and lower flaps, the box-sheet-holding part holds each box sheet such that the upper flaps extend upward from an upper side of the box sheet and the lower flaps extend downward from a lower side of the box sheet;

an extraction part to extract one of the box sheets from the box-sheet-holding part;

a plurality of suction tools to grip a surface of the box sheet moved by the extraction part by suctioning air;

a folding assist member adapted to contact the box sheet such that, when the extraction part supports the box sheet and the suction tools grip the box sheet, the box sheet folds at a crease formed between a portion supported by the extraction part in the upright direction and a portion gripped by the suction tools in a vertical direction;

an upright-direction dimension of the box sheet being a first dimension; and the extraction part for moving the box sheet in the upright direction by a second dimension, the second dimension shorter than the first dimension.

2. The case-making device according to claim 1, wherein the upright direction is a direction that is inclined from 0° to 30° from a vertical direction.

3. The case-making device according to claim 1, wherein the extraction part raises the box sheet upward from below.

4. The case-making device according to claim 1, wherein:

the box-sheet-holding part has a support member to support a surface of the box sheet; and the support member supports the box sheet within a range that is shorter than the second dimension from a lower edge of the box sheet.

5. The case-making device according to claim 1, wherein the box sheet is opened by movement of at least some of the plurality of suction tools.

6. The case-making device according to claim 5, wherein the plurality of suction tools includes:

a first suction tool to grip a first surface of the box sheet; and a second suction tool to grip a second surface of the box sheet that is on the opposite side from the first surface.

7. The case-making device according to claim 5, wherein when a not-yet-opened box sheet is gripped by the plurality of suction tools, the box sheet takes on an orientation along a vertical direction.

8. The case-making device according to claim 5, wherein a difference in height between an upper edge of the box sheet gripped by the suction tools and a lower edge of the box sheets held by a box-sheet-holding tool is less than double the first dimension of the box sheet.

* * * * *